US008677609B2

(12) United States Patent
Shang

(10) Patent No.: US 8,677,609 B2
(45) Date of Patent: Mar. 25, 2014

(54) METHOD FOR PRODUCING A CIRCUIT-BREAKER POLE PART

(71) Applicant: ABB Technology AG, Zurich (CH)

(72) Inventor: Wenkai Shang, Ratingen (DE)

(73) Assignee: ABB Technology AG, Zurich (CH)

( * ) Notice: Subject to any disclaimer, the term of this patent is extended or adjusted under 35 U.S.C. 154(b) by 0 days.

(21) Appl. No.: 13/741,833

(22) Filed: Jan. 15, 2013

(65) Prior Publication Data

US 2013/0126479 A1 May 23, 2013

Related U.S. Application Data

(63) Continuation of application No. PCT/EP2011/003539, filed on Jul. 15, 2011.

(30) Foreign Application Priority Data

Jul. 15, 2010 (EP) ..... 10007319

(51) Int. Cl.
*H01H 65/00* (2006.01)

(52) U.S. Cl.
USPC ..... 29/622; 29/450; 29/874; 218/118

(58) Field of Classification Search
USPC ..... 218/118–120; 29/622, 450, 874
See application file for complete search history.

(56) References Cited

U.S. PATENT DOCUMENTS

| | | | | |
|---|---|---|---|---|
| 5,698,831 | A | 12/1997 | Abdelgawad et al. | |
| 5,729,888 | A | 3/1998 | Abdelgawad et al. | |
| 7,843,293 | B1 | 11/2010 | Bonjean et al. | |
| 7,866,031 | B2 * | 1/2011 | Stoving et al. | 29/622 |
| 2005/0016963 | A1 * | 1/2005 | Stoving et al. | 218/120 |
| 2008/0041825 | A1 * | 2/2008 | Stoving et al. | 218/120 |
| 2008/0087647 | A1 * | 4/2008 | Volkmar | 218/134 |
| 2008/0142485 | A1 * | 6/2008 | Gentsch et al. | 218/118 |
| 2012/0274428 | A1 * | 11/2012 | Reuber et al. | 335/6 |

FOREIGN PATENT DOCUMENTS

| | | | |
|---|---|---|---|
| DE | 199 10 326 | A1 | 9/2000 |
| DE | 10 2004 060274 | A1 | 6/2006 |
| DE | 10 2007 042041 | B3 | 2/2009 |

(Continued)

OTHER PUBLICATIONS

International Search Report (PCT/ISA/210) issued on Oct. 18, 2011, by the European Patent Office as the International Searching Authority for International Application No. PCT/EP2011/003538.

(Continued)

*Primary Examiner* — Truc Nguyen
(74) *Attorney, Agent, or Firm* — Buchanan Ingersoll & Rooney PC

(57) ABSTRACT

Exemplary embodiments of the present disclosure are directed to a method for producing a circuit-breaker pole part by molding an external insulating sleeve with insulation material, mounting a vacuum interrupter insert inside the insulating sleeve, electrically connecting the vacuum interrupter insert with an upper electrical terminal and a lower electrical terminal arranged in the wall section of the insulating sleeve The method also includes molding the external insulating sleeve, wherein only the upper electrical terminal is embedded in the insulation material, coating the vacuum interrupter insert with an extra layer made of insulation material for thermo extension compensation, mounting the coated vacuum interrupter insert by screwing on a threaded bolt onto the upper electrical terminal.

15 Claims, 4 Drawing Sheets

(56) References Cited

FOREIGN PATENT DOCUMENTS

| | | | |
|---|---|---|---|
| GB | 1 030 798 | A | 5/1966 |
| WO | WO 00/41199 | A1 | 7/2000 |
| WO | WO 03/005389 | A1 | 1/2003 |
| WO | WO 2010/058034 | A1 | 5/2010 |

OTHER PUBLICATIONS

Written Opinion (PCT/ISA/237) issued on Oct. 18, 2011, by the European Patent Office as the International Searching Authority for International Application No. PCT/EP2011/003538.

Search Report issued on Dec. 10, 2010, by the European Patent Office for Application No. 10007321.2.

Search Report issued on Mar. 17, 2011, by the European Patent Office for Application No. 10007321.2.

International Search Report (PCT/ISA/210) issued on Nov. 3, 2011, by the European Patent Office as the International Searching Authority for International Application No. PCT/EP2011/003539.

Written Opinion (PCT/ISA/237) issued on Nov. 3, 2011, by the European Patent Office as the International Searching Authority for International Application No. PCT/EP2011/003539.

Search Report issued on Dec. 10, 2010, by the European Patent Office for Application No. 10007319.6.

Search Report issued on Apr. 1, 2011, by the European Patent Office for Application No. 10007319.6.

* cited by examiner

METHOD FOR PRODUCING A CIRCUIT-BREAKER POLE PART

RELATED APPLICATION(S)

This application is a continuation under 35 U.S.C. §120 of International Application PCT/EP2011/003539 filed on Jul. 15, 2011 designating the U.S. and claiming priority to European application EP10007319.6 filed on Jul. 15, 2010, the content of each application is hereby incorporated by reference in its entirety.

FIELD

The disclosure relates to a method for producing a circuit-breaker pole part and a pole part produced by such a method as well as a circuit-breaker arrangement for medium-voltage applications.

BACKGROUND INFORMATION

Known circuit-breaker pole parts can be integrated in a medium-voltage to high-voltage circuit-breaker arrangement, such as medium-voltage circuit-breakers rated between 1 and 72 kV of a high current level. These specific circuit breakers interrupt the current by generating and extinguishing the arc in a vacuum. Inside the vacuum chamber a pair of electrical switching contacts is arranged. Modern vacuum circuit-breakers tend to have a longer life time than former air, oil circuit-breakers. Although, vacuum circuit-breakers replaced air, oil circuit-breakers, the present disclosure is not only applicable to vacuum circuit-breakers but also for air, oil circuit-breakers or modern SF6 circuit-breakers having a chamber filled with sulfurhexafluoride gas instead of vacuum.

For actuating a circuit-breaker, a magnetic actuator with a high force density is used with moves one of the electrical contacts of a vacuum interrupter for a purpose of electrical power interruption. Therefore, a mechanical connection between a movable armature of the magnetic actuator and the movable electrical contact inside the vacuum interrupter insert is provided.

The document DE 10 2004 060 274 A1 discloses a method for producing a circuit-breaker pole part for a medium voltage or high voltage circuit-breaker. A vacuum interrupter is embedded in an insulating material and encapsulated with said material. The vacuum interrupter itself substantially comprises an insulator housing which can be cylindrical and which is closed at the ends in order to form an inner vacuum chamber. The vacuum chamber contains a fixed electrical contact and a corresponding movable electrical contact forming an electrical switch. A folding bellows is arranged on the movable electrical contact side and permits a movement of the movable electrical contact over the current feed line within the vacuum chamber. As mentioned, a vacuum is inside the vacuum interrupter in order to quench as rapid as possible the arc produced during the switching-on or switching-off action.

The vacuum interrupter inside the insulating sleeve is fully encapsulated by a synthetic material, mostly plastic material, in order to increase the external dielectric strength of the vacuum interrupter. Furthermore, the synthetic material serves as a compensation material for the purpose of compensating for different coefficient of thermal expansion between the vacuum interrupter surface and the surrounding insulating sleeve. This additional function of the intermediate layer avoids possible initiation of cracks.

During the manufacturing process of the circuit-breaker pole part two external electrical terminals are mounted in the wall section of the insulating sleeve in a first step. In a second step, the pre-mounted interrupter insert is dipped into a liquid rubber solution forming the above-mentioned intermediate layer. In a third step, the external insulating sleeve is produced in a plastic injection-molding process by the vacuum interrupter being encapsulated with plastic material. During encapsulating the interrupter by molding under a high process temperature, the liquid rubber solution vulcanizes and forms the intermediate compensating layer as described above. For the last productions step of vulcanization a heated molded form is necessary.

SUMMARY

An exemplary method for producing a circuit-breaker pole part is disclosed, comprising: molding an external insulating sleeve with insulation material; mounting a vacuum interrupter insert inside the insulating sleeve; electrically connecting the vacuum interrupter insert with an upper electrical terminal and a lower electrical terminal arranged in a wall section of the insulating sleeve; molding the insulating sleeve, wherein at least only the upper electrical terminal is embedded in the insulation material during molding; coating the vacuum interrupter insert with an extra layer made of at least one of insulation material at least towards the bottom line open air gap directly between the extra layer and the insulator sleeve, and between the vacuum interrupter insert and the insulator sleeve for better electrical performance; and mounting the coated vacuum interrupter insert by screwing on a threaded bolt onto the upper electrical terminal before molding or after molding.

BRIEF DESCRIPTION OF THE DRAWINGS

The foregoing and other aspects of the disclosure will become apparent following the detailed description of the disclosure, when considered in conjunction with the enclosed drawings.

DETAILED DESCRIPTION

Figure 1:
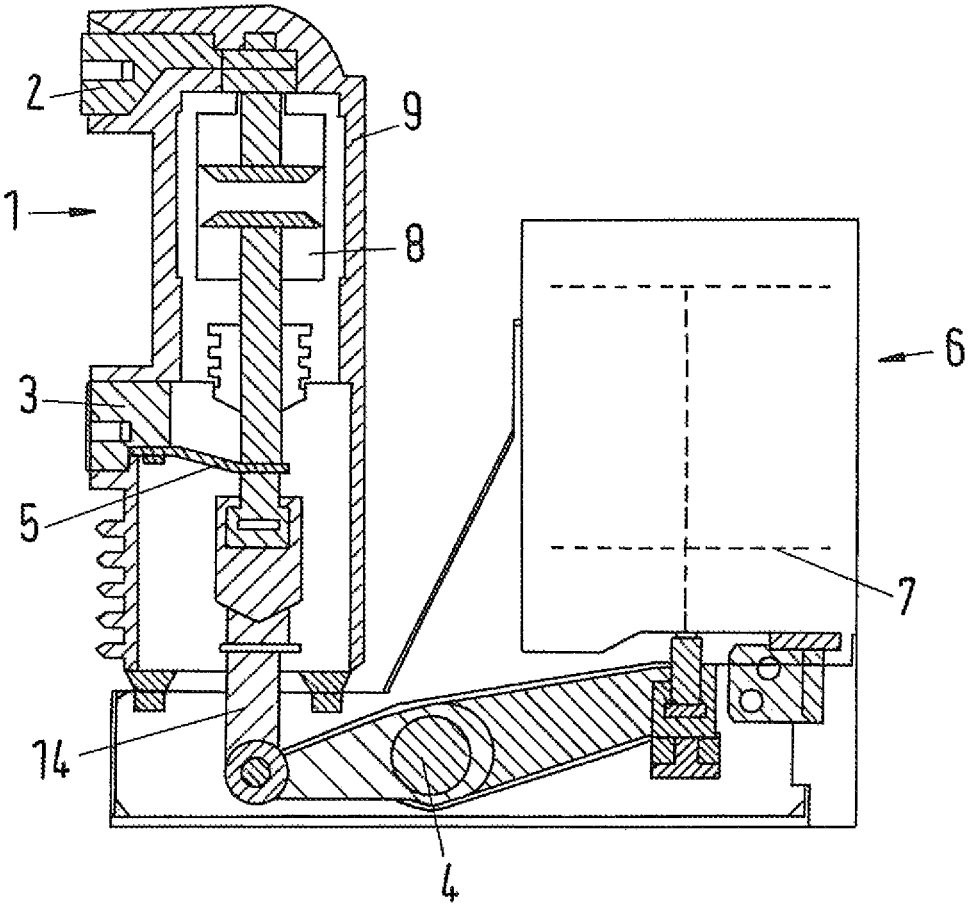
FIG. 1 is a side view of a medium-voltage circuit-breaker operated by a single magnetic actuator in accordance with an exemplary embodiment of the present disclosure.

Exemplary embodiments of the present disclosure provide a method for efficiently producing a pole part for a circuit-breaker arrangement including (e.g., comprising) an effective compensation layer around the vacuum interrupter or no stress solution around vacuum interrupter.

According to an exemplary embodiment of the disclosure a method for producing a circuit-breaker pole part comprises an external insulating sleeve made of insulating material for supporting and housing an inner vacuum interrupter for electrical switching a medium voltage circuit, including the following specific production steps, molding the external insulating sleeve, wherein at least only the upper electrical terminal is embedded in the insulation material during moulding process, coating the vacuum interrupter insert with an extra layer made of insulation material and/or an at least towards the bottom line open air gap directly between the extra layer and the insulator sleeve and/or between the vacuum interrupter insert and the insulator sleeve for better electrical performance, mounting the coated vacuum interrupter insert by screwing on a threaded bolt onto the upper electrical terminal before moulding or after moulding.

In an exemplary embodiment, the following steps can be added, preassembling the vacuum interrupter to the upper terminal, put this preassembled arrangement into the mould, mold the external insulating sleeve together with the lower terminal order to form a complete assembly thereby.

An insulation cover can be placed also as a sealing part between the upper terminal and the mould.

During moulding, the upper terminal acts as a mechanical protection due to the high operation pressure. The insulating cover could be used as a sealing part between the upper terminal and the mould, and acts also as an insulation layer. Also the sealing to the mould could be directly between the upper terminal and the mould.

An exemplary embodiment is provided, by partly closing the gap with a suitable dielectric insulating after completing the moulding.

Exemplary embodiments disclosed herein provide advantages such as mechanical stress between the vacuum interrupter and the insulator, directly sealed terminal, without any conditions for closing the assembly screw area, ready made with one step moulding process, easy process.

Due to embedding only the upper electrical terminal during the molding production step of the external insulating sleeve the vacuum interrupter can be assembles afterwards. If there is no direct connection between external insulation material and vacuum interrupter with or without insulation layer, therefore no mechanical stress between the vacuum interrupter and external insulation sleeve occurs. This provides reliable performance. The vacuum interrupter could be coated with an extra layer made of a suitable insulation material, or without insulation material. This depends on the voltage level. Finally, the vacuum interrupter insert is mountable by screwing and surely could be also removed from the surrounding insulating sleeve for repairing purposes.

According to another exemplary embodiment of the disclosure, the lower electrical terminal can be assembled in the wall of the insulating sleeve before or after the vacuum interrupter has been mounted or could be moulded into the insulating sleeve. Then, the vacuum interrupter insert will be connected with the lower electrical terminal via a flexible connector band.

Due to the mounting techniques for attaching the coated vacuum interrupter inside the insulating sleeve by screwing a lateral gap between the coated vacuum interrupter insert and the inner wall of the surrounding external insulating sleeve occurs. It is possible to cast a sealing compound into the lateral gap in order to at least partly fill the lateral gap for increasing the bonding effect as well as the dielectric insulation.

According to exemplary embodiments described herein, any suitable electrical insulation material could be used.

In an exemplary embodiment the insulation material of the insulating sleeve is an epoxy material. It is also possible to use other suitable synthetic materials on the basis of thermal plastic material, e.g., polybutylenterephthalat (PBT) or thermoplastic polyurethane (TPUR), or PPA, Peak, etc.

In order to achieve a suitable extra layer for electrical insulation purpose on the outer surface of the vacuum interrupter in a fast and reliable production step an exemplary embodiment of the present disclosure provides for creating the extra layer by a shrinkage tube made of plastic material. Only one production step is necessary in order to form the extra layer on the lateral area of the vacuum interrupter. No additional primer or other material as well as intermediate production steps are specified. Results of several tests come to the conclusion that hot-shrinkage tube material provides a sufficient insulation for vacuum interrupter inserts. Furthermore, such an extra layer protects the vacuum interrupter insert for damages.

According to another exemplary embodiment of the present disclosure an additional insulating cup made of insulating material is provided. That insulating cup covers at least partly the bottom area of the upper terminal between the insulating sleeve and the upper part of the vacuum interrupter insert which is arranged adjacent to the upper electrical terminal.

In an exemplary embodiment described herein the additional insulation cup can be disc-shaped with a bended border section extending inwardly to the insulating sleeve. The cup provides an additional electrical protection between the upper electrical terminal and the electrical contacts inside the vacuum interrupter.

The pole part according to the present disclosure can be used in connection with a 3-phase power grid comprising three identical pole parts which are driven via a common jackshaft arrangement by a single magnetic actuator.

FIG. 1 is a side view of a medium-voltage circuit-breaker operated by a single magnetic actuator in accordance with an exemplary embodiment of the present disclosure. The medium-voltage circuit-breaker as shown in FIG. 1 principally consists of at least a pole part 1 with an upper electrical terminal 2 and a lower electrical terminal 3 forming an electrical switch for a medium-voltage circuit.

Therefore, the lower electrical terminal 3 is connected to a corresponding electrical contact which is movable between a closed and an opened switching position via a jackshaft arrangement 4. A flexible connector band 5 of copper material is provided in order to electrically connect the lower electrical terminal 3 with the inner electrical switch.

The jackshaft arrangement 4 internally couples the mechanical energy of a bistable magnet actuator 6 to the pole part 1. The magnetic actuator 6 consists of a bistable magnetic arrangement for switching of a armature 7 to the relative position as effected by magnetic fields generated by an—not shown—electrical magnetic as well as a permanent magnetic arrangement.

In an exemplary embodiment of the present disclosure, the pole part 1 comprises an inner vacuum interrupter insert 8 which is surrounded by an external insulating sleeve 9 made of insulation material, e. g. epoxy material. The insulating sleeve 9 supports and houses the vacuum interrupter insert 8 comprising the two corresponding electrical contacts which are switchable under vacuum atmosphere. Said electrical contacts of the vacuum interrupter insert 8 are electrical connected to the upper electrical terminal 2 and the lower electrical terminal 3 respectively as described above.

Figure 2A:
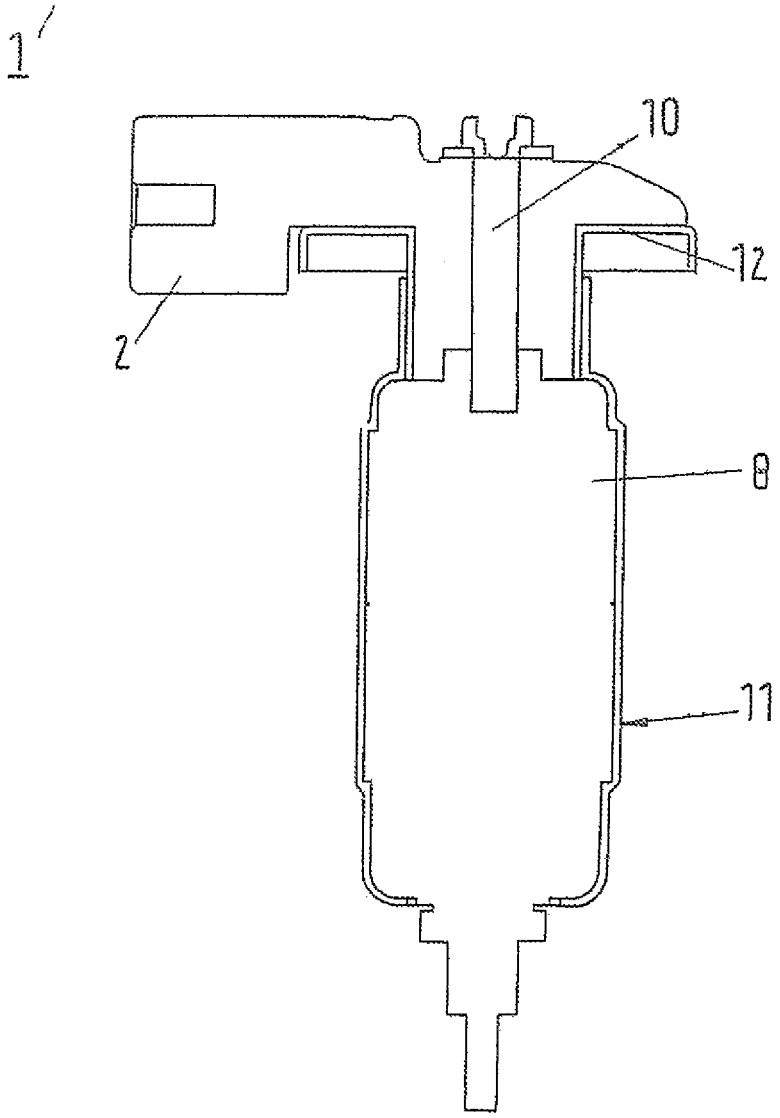
FIG. 2*a* illustrates a preassembled circuit-breaker arrangement in accordance with an exemplary embodiment of the present disclosure.

FIG. 2*a* illustrates a preassembled circuit-breaker arrangement in accordance with an exemplary embodiment of the present disclosure. As shown in FIG. 2*a* the preassembled group 1, which includes the vacuum interrupter 8, an extra layer 11, the upper terminal 2, the bolt 10 and the insulating cup 12, before this preassembled group 1 will be layered into the mould.

Figure 2B:
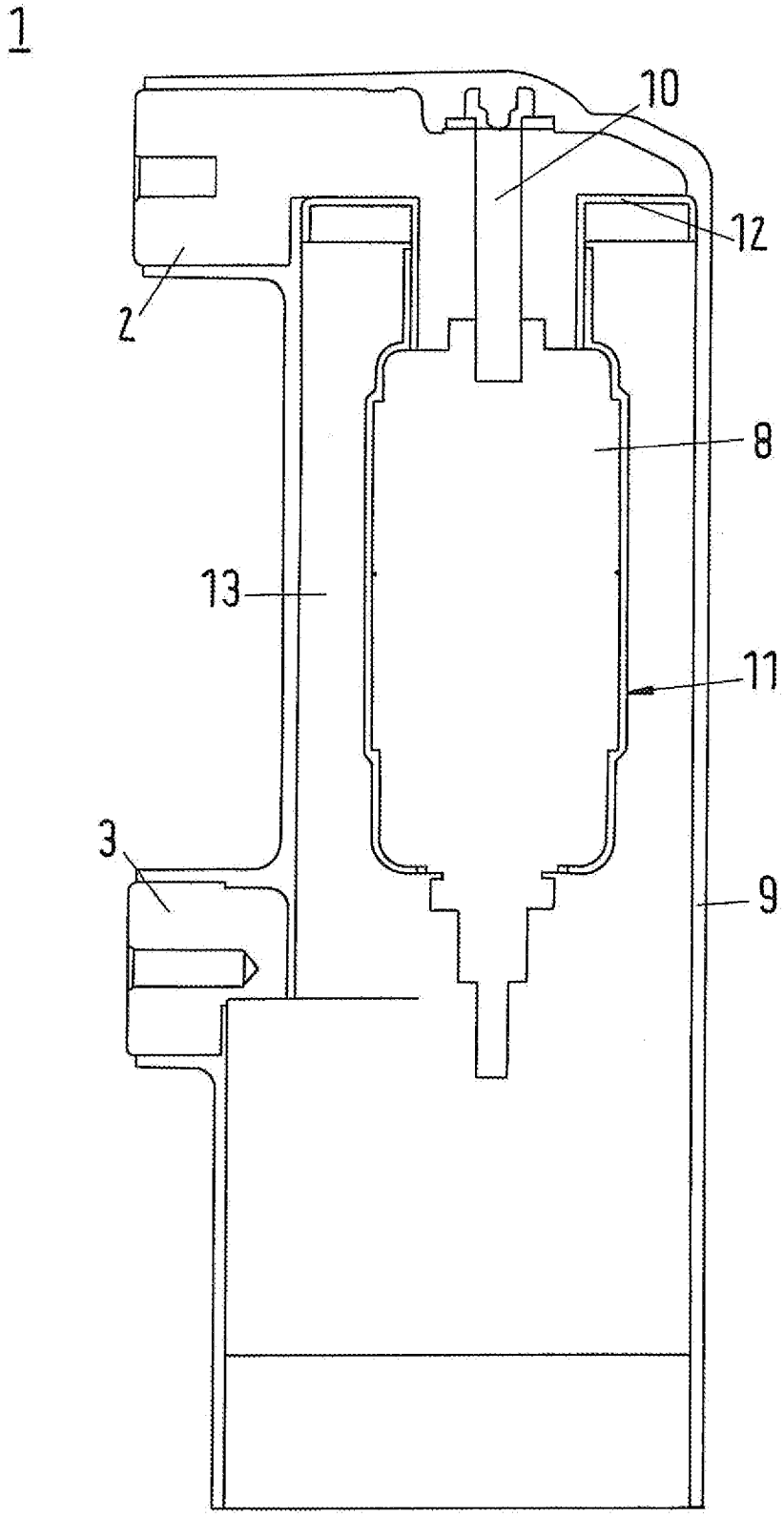
FIG. 2*b* illustrates a longitudinal section of a pole part of the circuit-breaker arrangement shown in FIG. 1 in accordance with an exemplary embodiment of the present disclosure.

FIG. 2*b* illustrates a longitudinal section of a pole part of the circuit-breaker arrangement shown in FIG. 1 in accordance with an exemplary embodiment of the present disclosure. As shown in FIG. 2*b* the inner vacuum interrupter 8 of the pole part 1 is attached by screwing onto a threaded bolt 10 of the upper electrical terminal 2. Before that mounting step the external insulating sleeve 9 has been molded wherein only the upper electrical terminal 2 has been embedded in the insulating material.

For a better electrical insulation the vacuum interrupter 8, is provided with an extra layer 11 made of insulation material, e. g. a hot shrinkage tube.

According to an exemplary embodiment of the present disclosure, for additional electrical insulation of the upper electrical terminal 2 to the vacuum interrupter 8, an insulation cup 12 can be arranged inwardly in the bottom area of the upper terminal 2 between the adjacent front side of the vacuum interrupter 8 and the insulating sleeve 9. A lateral gap 13 between the lateral area of the insulating sleeve 9 and the vacuum interrupter insert 8 is provided. It is possible to fill the lateral gap 13 at least partly with a sealing component if a higher dielectric insulation is specified, in order to get better mechanical stability and better electrical performance. The insulation material of the external insulating sleeve 9 is epoxy material or thermoplastic material according to the present example.

Figure 2C:
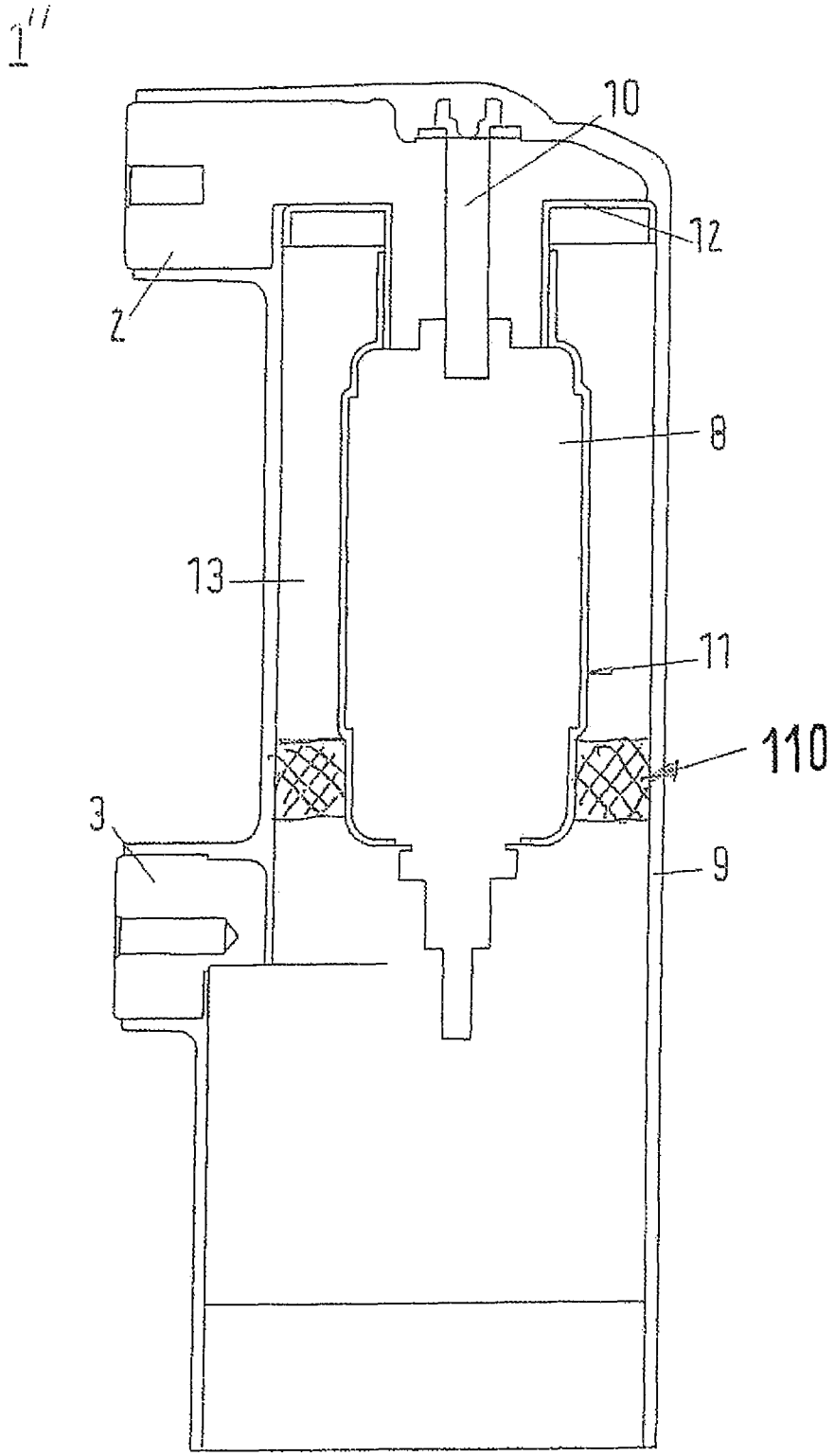
FIG. 2*c* illustrates a circuit breaker that includes a final sealing in accordance with an exemplary embodiment of the present disclosure.

FIG. 2*c* illustrates a circuit breaker that includes a final sealing in accordance with an exemplary embodiment of the present disclosure. As shown in FIG. 2*c*, the optional use of a final sealing 110 that is positioned after the moulding process.

Thus, it will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

REFERENCE SIGNS

1 pole part
2 upper electrical terminal
3 lower electrical terminal
4 jackshaft
5 connector band
6 magnetic actuator
7 armature
8 vacuum interrupter insert
9 insulating sleeve
10 threaded bolt
11 extra layer
12 insulation cup
13 lateral gap
14 push rod
110 sealing

What is claimed is:

1. A method for producing a circuit-breaker pole part, comprising:

molding an external insulating sleeve with insulation material;

mounting a vacuum interrupter insert inside the insulating sleeve;

electrically connecting the vacuum interrupter insert with an upper electrical terminal and a lower electrical terminal arranged in a wall section of the insulating sleeve;

molding the insulating sleeve, wherein at least only the upper electrical terminal is embedded in the insulation material during molding;

coating the vacuum interrupter insert with an extra layer made of at least one of insulation material at least towards a bottom line open air gap directly between the extra layer and the insulator sleeve, and between the vacuum interrupter insert and the insulator sleeve for better electrical performance; and mounting the coated vacuum interrupter insert by screwing on a threaded bolt onto the upper electrical terminal before molding or after molding.

2. The method according to claim 1, comprising:

assembling or molding the lower electrical terminal in the wall of the insulating sleeve; and electrically connecting the vacuum interrupter insert via a flexible connector band.

3. The method according to claim 1, comprising:

preassembling the vacuum interrupter to the upper terminal;

disposing the preassembled arrangement into the mould; and molding the external insulating sleeve together with the lower terminal order to form a complete assembly thereby.

4. The method according to claim 3, comprising:

placing an insulation cover as a sealing part between the upper terminal and the mold.

5. The method according to claim 3, comprising:

partly closing the gap with a suitable dielectric insulating after the complete assembly is moulded.

6. A pole part of a circuit-breaker produced by a method according to claim 1, wherein the insulation material of the insulating sleeve is epoxy material thermal plastic material on the basis of polybutylenterephthalat (PBT) or thermoplastic polyurethane (TPUR).

7. The pole part according to claim 6, wherein the extra layer on the outer surface of the vacuum interrupter insert is made of an insulation material.

8. The pole part according to claim 7, wherein the insulation material is one of a shrinkage tube or hotmelts or epoxy or silicon rubber.

9. The pole part according to claim 6, wherein an additional insulation cup made of an insulating material covers a bottom area of the upper terminal inner side between a front side of the vacuum interrupter insert and the insulating sleeve.

10. A circuit-breaker arrangement for medium-voltage applications comprising:

a magnetic actuator for generation of an operation force, transmitted via a jackshaft arrangement to at least one pole part according to claim 4.

11. The circuit-breaker arrangement according to claim 9, wherein for a 3-phase power grid, three pole parts are driven via a common jackshaft arrangement by a magnetic actuator, which could have one or multiple coils.

12. The circuit-breaker arrangement according to claim 10, wherein the axial of the upper and lower terminal is arranged in with an angle to the axial of the pole between 0 to 180°.

13. The circuit-breaker arrangement according claim 1, wherein the permanent magnetic actuator is a single coil or double coil magnetic actuator.

14. The circuit-breaker arrangement according to claim 13, wherein the permanent magnetic actuator is mounted directly under the pole with direction to push rod.

15. The circuit-breaker arrangement according to claim 1, wherein the pole part is made without extra insulation.

* * * * *